United States Patent [19]

Castillo et al.

[11] 4,093,681

[45] June 6, 1978

[54] MOTORLESS CARBONATOR

[75] Inventors: Herman B. Castillo, Clawson; Robert S. Mueller, Birmingham, both of Mich.

[73] Assignee: Eaton Corporation, Cleveland, Ohio

[21] Appl. No.: 749,938

[22] Filed: Dec. 13, 1976

[51] Int. Cl.[2] ..... B01F 3/04

[52] U.S. Cl. ..... 261/122; 99/275; 222/56; 222/129.1; 222/165; 261/50 R; 261/DIG. 7; 261/DIG. 75; 426/474; 426/477

[58] Field of Search ..... 261/50 R, 50 A, 76, 261/121 R, 122, 123, DIG. 7, DIG. 75, 51; 222/1, 160, 164, 165, 56, 61, 129.1; 99/275; 426/474, 477

[56] References Cited

U.S. PATENT DOCUMENTS

| | | | |
|---|---|---|---|
| 950,999 | 3/1910 | Erlwein et al. | 261/DIG. 7 |
| 3,256,802 | 6/1966 | Karr | 261/DIG. 7 |
| 3,394,847 | 7/1968 | Garrard | 222/61 X |
| 3,552,726 | 1/1971 | Kraft | 261/DIG. 7 |
| 3,572,550 | 3/1971 | Colomina et al. | 261/121 R X |
| 3,618,905 | 11/1971 | Primus | 261/DIG. 7 |
| 3,637,197 | 1/1972 | Hudson | 261/DIG. 7 |
| 3,746,323 | 7/1973 | Buffington | 261/DIG. 7 |
| 3,780,198 | 12/1973 | Pahl et al. | 261/DIG. 7 |
| 4,028,441 | 6/1977 | Richards | 261/DIG. 7 |

FOREIGN PATENT DOCUMENTS

| | | | |
|---|---|---|---|
| 827,946 | 2/1960 | United Kingdom | 261/DIG. 7 |

*Primary Examiner*—Tim R. Miles
*Assistant Examiner*—Richard L. Chiesa
*Attorney, Agent, or Firm*—R. J. McCloskey; D. L. Wood; G. L. Lewis

[57] ABSTRACT

A low-cost, motor-less carbonator has a housing having a fill chamber and a carbonation chamber. The chambers are maintained at different pressure levels to create a fluid movement from the fill chamber to the carbonation chamber. The fill chamber can be vented to allow a low pressure water feed to refill the fill tank. Carbonated water from the carbonation chamber is withdrawn on demand by a dispensing means.

5 Claims, 2 Drawing Figures

FIG. 1.
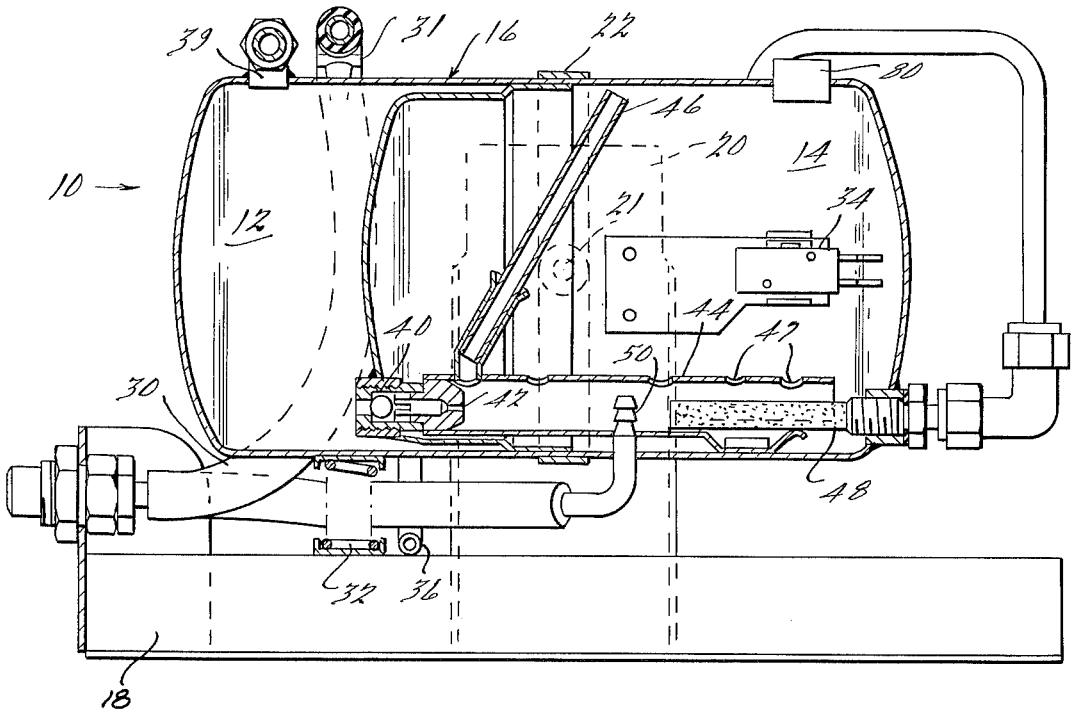
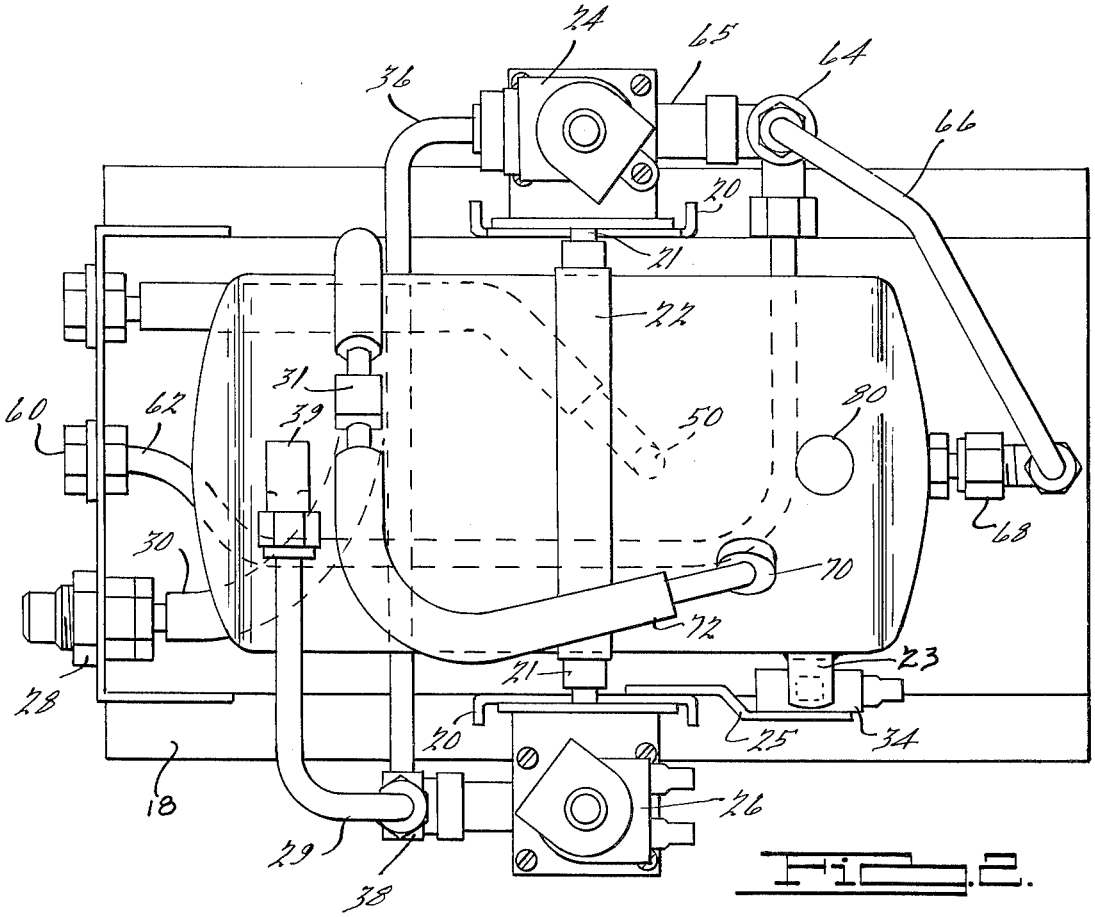
FIG. 2.

MOTORLESS CARBONATOR

BACKGROUND OF THE INVENTION

1. Field of the Invention

In one aspect, this invention relates to carbonation systems. In a further aspect, this invention relates to motorless carbonators.

2. Description of the Prior Art

In general, carbonation systems which are connected to city water have a motor driven booster pump to move water into the system, a tank for holding water for carbonation and a liquid level control. The motor driven pump and liquid level control are relatively expensive. In high dispensing volume carbonators, the use of such expensive components is necessary and justifiable. However, in a small, compact, inexpensive carbonator, such as might be used by an office or other low dispensing volume users, the use of motor driven pumps and expensive liquid level control devices is not economically attractive.

One example of a motorless carbonator is disclosed in U.S. Pat. No. 3,572,550. This disclosure shows a motorless carbonator wherein the storage chamber is vented to allow the flow of water into the chamber and the streams of liquid and gas intersect to effect carbonation. This carbonator provided an advance in the art. However, the device has certain limitations. The device is intended primarily for dispensing one drink at a time. Consequently, the device is frequently vented and consumes a large quantity of carbon dioxide, much of which is not used to carbonate the beverage.

A further example of the prior art is disclosed in U.S. Pat. No. 3,394,847. This patent shows a plurality of chambers connected through a spool valve and supplied with pressurized carbon dioxide. The unit is not contained within a single housing and uses a complex series of valves to constantly vary the pressure within the carbonation chamber, making the unit expensive.

SUMMARY OF THE INVENTION

Problems of the prior art are solved by a carbonator of the present invention which has a housing containing a fill chamber and a carbonation chamber which are in fluid communication. The fill chamber is connected to a source of fresh water.

Broadly, this invention includes a carbon dioxide pressure source which furnishes carbon dioxide to the fill chamber and carbonation chamber. The fill chamber is generally maintained at a higher pressure than the carbonation chamber, the pressure differential forcing water from the fill chamber into the carbonation chamber.

Venting means is associated with the fill chamber to lower the pressure in the fill chamber when the fill chamber is low on water. After venting, water is forced into the fill chamber by normal line pressure.

The carbonated water is withdrawn as needed and mixed with syrup at a dispensing means to provide a finished beverage.

One advantage of this arrangement is the provision of the fill and carbonation chambers in a single housing. This reduces the amount of space and expensive high pressure connections which are needed in the dispenser. Also, the two chamber approach means only the fill chamber is vented during refilling; therefore, the amount of carbon dioxide lost each time the fill chamber is vented to let in fresh water is minimized. Also, since the carbonation chamber is maintained at a substantially constant pressure, the quality of carbonated beverage is maintained at a consistently high level.

As a further feature of this invention, automatic filling is made possible by mounting the housing on a base so as to oscillate between a filling position and a full position. Servo mechanisms responsive to the oscillations will vent the fill chamber in the fill position to let in fresh water. The servo mechanism will allow the fill chamber to pressurize when full. Thereafter, water is forced into the carbonation chamber. The fill chamber will repeat the fill and force cycle until the carbonation chamber is essentially full.

BRIEF DESCRIPTION OF THE DRAWINGS

In the accompanying drawing:

FIG. 1 is a side view in section of one embodiment of the invention carbonator; and FIG. 2 is a top view of the carbonator shown in FIG. 1.

DESCRIPTION OF A PREFERRED EMBODIMENT

The carbonator of this invention designated generally 10 has a fill chamber 12 and a carbonation chamber 14 contained within a housing 16. The housing 16 is pivotably mounted atop a base member 18 by means of two standards 20. Ring 22 wraps around housing 16; trunnions 21 project from ring 22 and have journals received in standards 20. The housing 16 is free to oscillate. The oscillations will cause a projection 23 attached to the housing 16 to activate a reset switch 34 mounted on a stand 25. The switch 34 controls two solenoid controlled valves 24, 26. When one solenoid is energized, the other solenoid is deenergized.

At the beginning of a fill cycle, both chambers are pressurized with carbon dioxide. The fill chamber 12 has been depleted of water and counterbalance spring 32 causes that end of the housing 16 to ascend to a raised position. As the housing reaches this position, reset switch 34 on the housing is activated causing solenoid valve 24 to close. This prevents carbon dioxide from entering line 36. Simultaneously, solenoid valve 26 opens allowing carbon dioxide in fill chamber 12 to vent through line 29 to the atmosphere. As the carbon dioxide pressure in the fill chamber 12 decreases, water will enter through check valve 28. The check valve can comprise well known check valves which operate at the normal water pressure of city water supplies. The water is carried by a line 30 to a T-fitting 31 mounted atop the housing 16. The water can flow freely into the fill chamber 12 substantially filling the chamber.

When the fill chamber 12 has reached the desired level, the weight of the water within the fill chamber will overcome the force exerted by the counterbalance spring 32 and the end of housing 16 containing the fill chamber will descend, reactivating switch 34. The switch will open valve 24 admitting carbon dioxide to line 36 through fitting 38 and into line 29. As valve 24 is opened, valve 26 is closed to prevent venting of the carbon dioxide. The carbon dioxide enters the fill chamber 12 through fitting 39 mounted atop housing 16. The pressure in fill chamber 12 is higher than the pressure in carbonation chamber 14 so water can be forced into the carbonation chamber by the pressure differential.

Carbon dioxide is constantly furnished to an inlet 60 at a constant line pressure, e.g., 90 psi. The carbon dioxide pressurizes line 62 and flows to a T-fitting 64 and into lines 65 and 66. Line 65 supplies carbon dioxide to valve 24 which distributes it as mentioned hereinbefore. Line 66 supplies carbon dioxide to a check valve 68. Check valve 68 is designed to operate at a pressure differential to admit carbon dioxide to the carbonation chamber 14 at a pressure lower than the source. For example, if the carbon dioxide line 66 were maintained at about 90 psi, check valve 68 could be a spring loaded check valve designed to operate at a 7 psi differential so as to admit carbon dioxide to the carbonation chamber at about 83 psi. A further pressure drop of 13 psi through the sparger reduces the outlet pressure to 70 psi which is the operating carbonation chamber pressure.

During operation, fresh water passes through a check valve 40 and a venturi 42 into a diffuser shroud 44. The low pressure generated by venturi 42 causes the pressure in carbonation chamber 14 to force carbon dioxide gas present near the top of the carbonation chamber through conduit 46 where it is recycled into shroud 44. Carbon dioxide and water are mixed in the diffuser shroud 44 in the desired proportions to produce carbonated water. The large gas bubbles generated by the sparger 48 escape from the shroud via apertures 47 while the selectively graded smaller bubbles mix to form the carbonated water.

A relatively large carbonation chamber gives the carbonated water a residence time in which to absorb a greater amount of gas and come to equilibrium with the carbon dioxide. Also, the relatively large carbonation chamber adds surge capacity to the carbonator so more than one drink can be dispensed before refilling.

A slight pressure rise is generated in the carbonation chamber 14 during filling. As the water fills and compresses the gas in the carbonation chamber, a portion of the gas is forced into the venturi through conduit 46. The remaining gas is vented into the fill chamber when the fill chamber is in an unpressurized state. Venting differential pressure valve 70 mounted near the top of the carbonator housing 16 vents some carbon dioxide to the fill chamber. The venting valve 70 maintains a pressure differential between the chambers when water is entering the carbonation chamber 14 by exhausting gas from the carbonation chamber to the fill chamber 12. Venting valve 70 can be a spring loaded check valve which opens when the pressure in carbonation chamber 14 exceeds a given pressure, e.g., 70 psi in the present case. The carbon dioxide passes into line 72 where it is transmitted to T-fitting 31 and enters the fill chamber 12 to help pressurize the fill chamber.

When carbonated water is desired, water is withdrawn from an exit conduit 50 in fluid communication with the diffuser shroud 44. As water is being withdrawn from the shroud 44, carbon dioxide enters through the sparger 48 as well as through the venturi. The excess gas moves upward passing through apertures 47 into the carbonation chamber 14. After the carbonated water is withdrawn from the carbonation chamber 14, it passes into a cooling coil where the carbonated water is cooled dissolving any carbon dioxide bubbles. Such cooling coils are known in the art.

When carbonated water is withdrawn at conduit 50 while the fill chamber is being filled, the water flows past the sparger drawing large amounts of carbon dioxide bubbles into the water. This would normally result in drawing water with excess carbon dioxide. However, apertures 47 allow the larger bubbles, with greater buoyancy, to escape upward into the carbonation chamber while the smaller bubbles retain the carbonation at a proper level.

During operation, the pressure in the fill chamber varies from atmospheric to about 90 psi. The carbonation chamber generally cycles between 70 and 90 psi. A pressure relief valve 80 is provided as a safety device to prevent over pressurization of the fill chamber and the carbonation chamber.

The operation of the fill and force mechanism of this invention is such that the system will not continuously admit water when power to the unit is interrupted. This insures that the unit will not run continuously during a power failure and thereby flood the surroundings.

What is claimed is:

1. A carbonator for carbonating fluids comprising:

a housing defining a first fill chamber adapted to receive water and connected to a source of fresh water, and a second carbonation chamber;

fluid connection means having an inlet and outlet located within said housing, said inlet being in communication with the fill chamber and the outlet being in communication with said carbonation chamber, the connection means being adapted to transfer water from said fill chamber to said carbonation chamber;

means for supplying pressurized carbon dioxide to the fill chamber and to the carbonation chamber;

means cooperative with said carbon dioxide supply to maintain a pressure differential between the fill chamber and the carbonation chamber, the pressure differential means supplying carbon dioxide to the fill chamber at a first relatively high pressure and to the carbonation chamber at a second relatively low pressure;

a discharge port adapted to withdraw a carbon dioxide-water mixture from the carbonation chamber upon demand; and means responsive to depletion of water in the fill chamber to vent the fill chamber to atmospheric pressure, thereby allowing fresh water to flow freely into the fill chamber filling the fill chamber to a predetermined level; and means operative in response to filling of the fill chamber with water to the predetermined level to repressurize the fill chamber with carbon dioxide and stop filling.

2. The carbonator of claim 1 wherein said means to maintain a pressure differential between said chambers comprises a check valve which operates only when a predetermined pressure differential exists.

3. The carbonator of claim 1 wherein said housing is oscillatorily mounted on a base and includes a servo mechanism which responds to reciprocating motion of the housing during filling and will open a vent valve when the water supply in the fill chamber is depleted and will close the vent valve when the fill chamber is full.

4. The carbonator of claim 1 wherein the water is partially carbonated in the carbonation chamber by passing the water into a shroud and past a venturi tube which is in fluid communication with carbon dioxide gas, thereby pulling gas into the flowing stream of water.

5. The carbonator of claim 4 wherein carbon dioxide is bubbled into the shroud and the shroud has a plurality of apertures in its upper surface to allow large bubbles to escape into the upper portion of the carbonation chamber.

* * * * *